United States Patent [19]

Remp et al.

[11] Patent Number: 4,704,986

[45] Date of Patent: Nov. 10, 1987

[54] PIPE CLEANING OR TREATING PLANT

[75] Inventors: Stephen E. Remp, Inverurie; Rodger M. H. Ewen, Stonehaven; Norman S. Cumming, Aberdeen, all of Scotland

[73] Assignee: Ramco Oil Services, Great Britain

[21] Appl. No.: 889,607

[22] Filed: Jul. 28, 1986

Related U.S. Application Data

[63] Continuation of Ser. No. 633,794, Jul. 24, 1984, abandoned.

[30] Foreign Application Priority Data

Jul. 27, 1983 [GB] United Kingdom ..... 8320292

[51] Int. Cl.[4] ..... B05B 13/06

[52] U.S. Cl. ..... 118/318; 118/317; 118/DIG. 10; 118/DIG. 11; 51/411

[58] Field of Search ..... 427/72; 118/317, 318, 118/DIG. 10, DIG. 11; 51/411

[56] References Cited

U.S. PATENT DOCUMENTS

| | | | |
|---|---|---|---|
| 2,734,832 | 2/1956 | Lewis | 118/318 |
| 3,164,491 | 1/1965 | Brockett et al. | 118/318 |
| 3,523,391 | 8/1970 | Levinson et al. | 51/411 |
| 3,835,587 | 9/1974 | Hall | 51/411 |
| 4,064,293 | 12/1977 | Nicklas | 51/411 X |
| 4,096,300 | 6/1978 | Williams et al. | 118/72 X |
| 4,474,134 | 10/1984 | Snow | 118/318 |

*Primary Examiner*—Shrive P. Beck

*Attorney, Agent, or Firm*—Wood, Herron & Evans

[57] ABSTRACT

Plant is described for cleaning or treating the insides of pipes, tubes and the like. The plant comprises a pipe-receiving station, a cleaning station and means for conveying the pipes, tubes and the like towards and away from the cleaning station in a direction transverse to their axes. The cleaning station includes elongated lance means with spray means at one end and mean for moving the lance means and a pipe, tube or the like axially relative to one another to cause the spray means to traverse the inside of the pipe, tube or the like and spray it with, for example, abrasive material. The inside of the pipe, tube or the like may also be sprayed with treatment liquid or rust-proofing liquid.

Two pipes at a time may be treated and the whole plant is preferably so constructed as to be mobile, being constructed of readily assemblable units arranged in a number of standard I.S.O. shipping containers.

12 Claims, 4 Drawing Figures

PIPE CLEANING OR TREATING PLANT

This application is a continuation of application Ser. No. 633,794, filed July 24, 1984, now abandoned.

FIELD OF THE INVENTION

This invention relates to plant for cleaning or treating lengths of pipe, tube and the like such as are used in the oil industry, the chemical process industries and the pipe line industries.

BACKGROUND OF THE INVENTION

In the oil and chemical process industries, various oleaginous and aqueous liquids and vapours are conveyed through pipes and tubes, sometimes at elevated temperatures and pressures, and sometimes the pipes and tubes may be left empty. During use, the insides of the pipes and tubes become encrusted with scale or carbonaceous deposits, or become rusty. The formation of such deposits of scale, carbonaceous material or rust can seriously restrict the flow through the pipes or tubes or reduce the rate of heat transfer through them.

Furthermore, with new pipes or tubes, it is necessary to clean the insides or otherwise treat them in order to render them fit for service. New pipes usually contain an adherent layer of mill scale due to the manufacturing process and problems will arise in service if the mill scale should become detached as it can clog and interfere with various instrumentalities with which the pipe or tube is used.

This is a particular problem with pipe, tubing and casing used in the oil recovery industry where the tubing or casing and the various instrumentalities are located undersea at depths of several hundred feet.

SUMMARY OF THE INVENTION

It is an object of the invention to provide a plant for cleaning or treating lengths of pipe, tube and the like and it is a subsidiary object to provide such a plant which is mobile and can be readily transported to a site where pipes, tubes and the like are to be cleaned or otherwise treated.

According to the present invention there is provided plant for cleaning or treating the insides of pipes, tubes and the like, characterised in that the plant comprises a pipe-receiving station for receiving pipes, tubes and the like to be cleaned or treated, a cleaning station and means for conveying the pipes, tubes and the like towards and away from the cleaning station in a direction transverse to their axes, and in that said cleaning station comprises elongated lance means, spray means at one end of said lance means, means for conveying cleaning or treating material to said spray means and means for moving said lance means and a pipe, tube or the like axially relative to one another to cause said spray means to traverse the inside of the pipe, tube or the like.

The present plant is conveniently constructed so as to be capable of cleaning and treating all types of pipe and tube used in the oil, chemical and pipe line industries, particularly those generally designated as casing and tubing and to be capable of treating such pipes and tubes of lengths usually obtaining in these industries, and generally up to about 45' (13.7 m.).

In one preferred embodiment of the plant the cleaning station comprises lance means and spray means adapted to spray grit, sand, shot or like abrasive material to clean the insides of the pipes or tubes and wheeled carriage means adapted to support the pipes or tubes while they are being cleaned. The lance means may be fixed and the wheeled carriage means may then be movable to convey the pipes or tubes along the lance means. Alternatively, the lance means may be movable while the wheeled carriage is held stationary. Preferably, means are provided for recovering and recycling the abrasive material and these means may either be movable together with the wheeled carriage means or may be stationary in which case the wheeled carriage serves to receive the pipes or tubes to be cleaned and engage one end thereof with the abrasive material recovery means while the lance means are moved along the pipes or tubes from the other end. The abrasive material recovery means serves to collect the abrasive material, mill scale, dust or other pipe debris and to separate the abrasive material for re-use while the other material is recovered for disposal.

The cleaning station may additionally comprise means for cleaning the outside of the pipes, tubes or the like, in the form of an abrasive cleaning installation. The installation may take the form of wire brushes or the like which may rotate relative to the pipe or tube, or may be in the form of an installation for spraying or blasting abrasive material onto the outside of the pipe. Preferably, means are provided at the cleaning station to rotate the pipe or tube to facilitate the cleaning of the outside of the pipe or tube.

The cleaning station may also include movable auxiliary lance means, preferably a single lance spaced from the first mentioned lance means, and means for moving the auxiliary lance means along a pipe, tube or the like. The auxiliary lance means may be provided with means for testing and/or dimensionally checking the inside of a pipe or tube, and/or may be provided with means for spraying the inside of a pipe or tube with a treatment liquid, such as a rust preventative or rust-inhibitor liquid.

Preferably, the plant is constructed so as to be mobile, the various units of the plant being arranged in separate units which can be readily assembled to form the complete plant. Conveniently, the various units are arranged in a number of 40' (12.2 m.) standard I.S.O. shipping containers. In one such embodiment, a first shipping container essentially houses the lance means and second and third shipping containers are axially aligned with the first. Depending upon the lengths of pipe to be cleaned or treated, the lance means may project into the second container. The first, second and third containers have rails on their floors along which carriages are movable, the carriages serving to support and rotate a pipe at the cleaning station and to move the pipe axially towards the lance means so that the spray means at the end thereof can spray the interior of the pipe with grit. Preferably, two fixed lances are provided for spraying grit and each carriage is arranged to support two pipes so that two pipes can be gritted simultaneously. A third or auxiliary lance is provided for spraying the interior of the pipe with rust inhibitor and this lance means may be arranged at a separate part of the cleaning station. Various ancilliary parts of the plant are housed in one or other of the containers and there may be one or more further containers for other ancilliary equipment, including air compressing and drying equipment, dust collecting equipment and grit-recovery equipment.

In this embodiment it will be appreciated that the plant can be packed into the containers which can then be mounted in lorries and conveyed to a location where pipes, tubes or the like are to be cleaned or treated. At the location, the containers can be demounted and appropriately assembled, and, after connection of the various services required and the ancilliary equipment, the plant can be brought into operation.

DETAILED DESCRIPTION OF THE DRAWINGS

In order to enable the invention to be more readily understood, reference will now be made to the accompanying drawings, which illustrate diagrammatically and by way of example an embodiment thereof, and in which.

Figure 1:
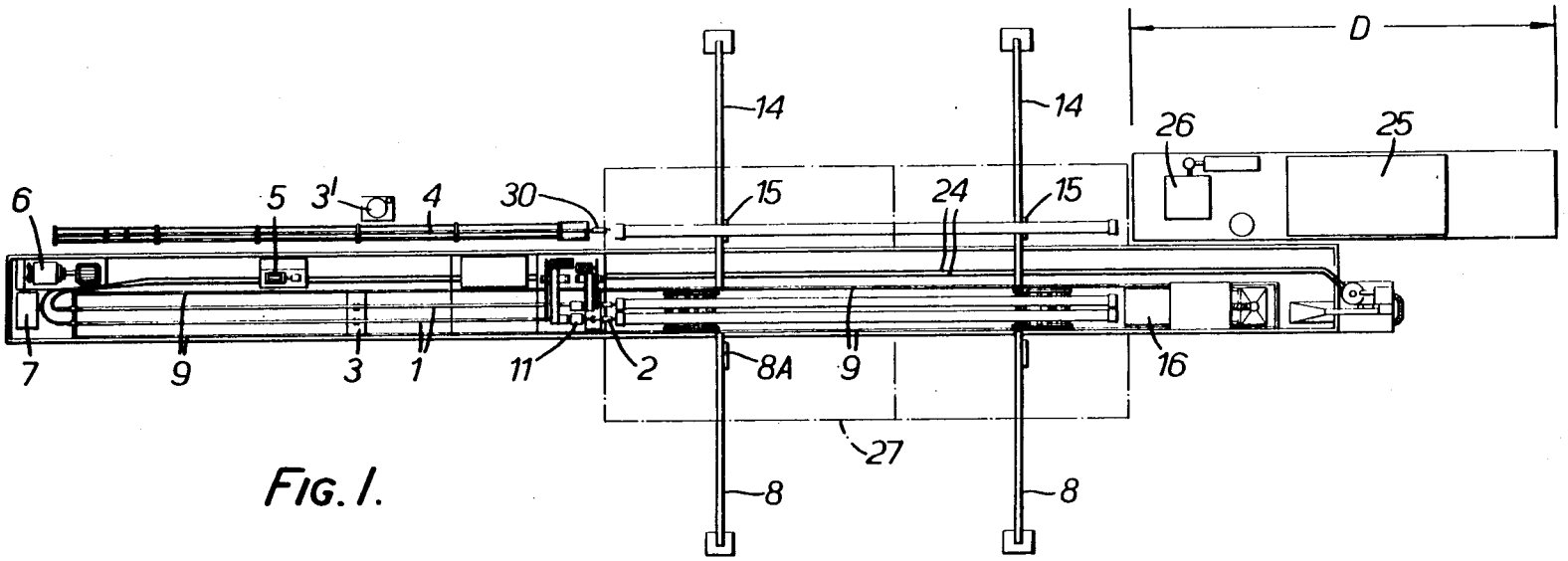
FIG. 1 is a schematic plan view of a pipe-cleaning plant.
Figure 2:
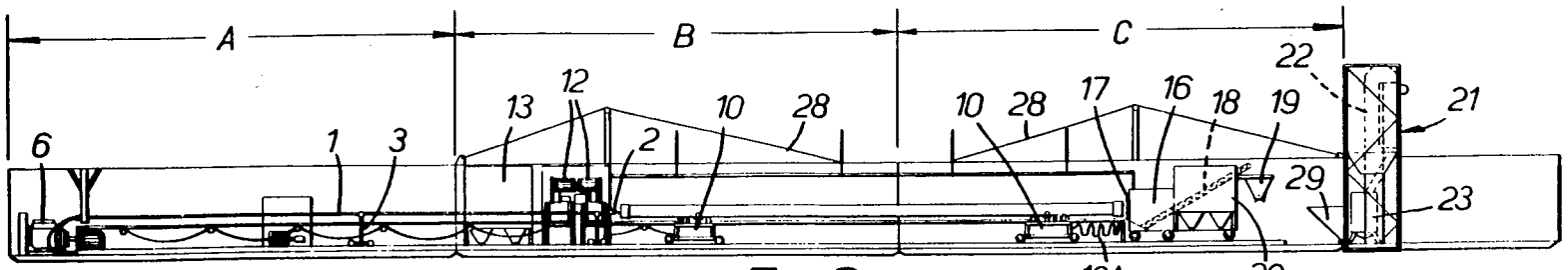
FIG. 2 is a schematic side view of the plant shown in FIG. 1.

Referring now to FIGS. 1 and 2 of the drawings, there is shown a mobile pipe cleaning plant formed from four standard 40′ I.S.O. shipping containers A, B, C and D. The containers A, B and C are axially aligned and the fourth container D which contains service equipment stands separately.

Figure 3:
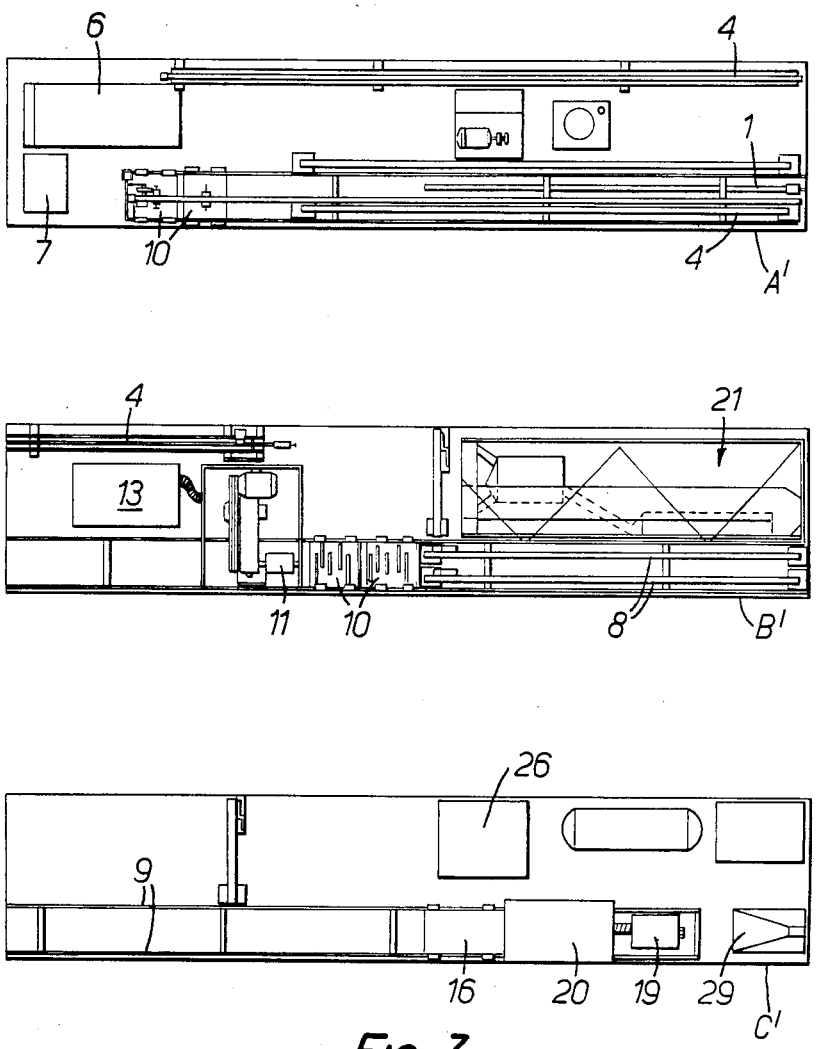
FIG. 3 is a schematic view showing the plant stowed in three standard I.S.O. containers ready for shipment.

The container A contains the blasting lances 1 carrying blasting heads 2 with nozzles for spraying or blasting grit on to the inside of pipes. The lances are supported on a lance support car 3 which is movable along rails on the floor of the container. It will be seen that the lances extend into the second container B, but as shown in FIG. 3, to be discussed later, they can be dismantled and stowed in container A. The container A is also associated with an auxiliary spray lance 4 which is mounted adjacent but spaced from the lances 1 and is movable by a hydraulic power unit 5 in the container A which also houses a power generating set 6 and a fuel tank 7.

The containers B and C are arranged so that parts of their sidewalls 27 can open up to their full depths, as shown in FIGS. 1 and 2, to enable pipes to be cleaned to be passed in a direction transverse to their axes through the containers. A feed-in or entry rack unit is located on one side of the containers and comprises two supported bars 8 extending at right angles to the length of the containers for supporting the pipes to be cleaned. The floors of the containers A, B and C mount rails 9 along which two wheeled carriages 10 and the lance support car 3 are movable. Each carriage is arranged to support two pipes in side-by-side arrangement and is provided with means (not described in detail) for rotating the pipes when so supported. Each bar 8 is associated with an air-operated feed-in arm 8A for lifting one pipe at a time allowing it to roll over a stop (not shown) and come to rest on the wheeled carriages 10. Each carriage is provided with a movable arm for lifting the pipes out of the carraige on completion of a cleaning operation. The distance between the carriages can be varied to accommodate difference pipe lengths. The carriages are movable by means of an endless chain (not shown) and the means for rotating the pipes is electrically driven. Although the electric cable 10A for the rotating means is shown draped in concertina fashion, it is preferred to mount the cable in a hose reel to minimise the risk of damage to the cable.

Although two wheeled carriages 10 are shown it will be appreciated that more than two may be provided or auxiliary support carriages may be provided if extra support is required for small diameter pipes.

The container B also houses two rotary wire brushes 11 and driven means 12 therefor, for the purpose of cleaning the outsides of the pipes, the brushes 11 being associated with a dust collector 13.

On the other side of the containers B and C there are two further bars 14 in the form of an exit rack for receiving cleaned pipes, the bars mounting centering stops 15 for locating a pipe in relation to the spray lance 4.

The container C houses a reclaim car 16 for recovering grit. The end of the car 16 is provided with a connection 17 whereby it can be attached in an air-tight manner over the ends of the pipes being cleaned. The reclaim car is fitted with a screw conveyor 18 for conveying spent grit to a rear-mounted hopper 19 and with a dust collector 20. The reclaim car 16 is wheeled and is also movable along the rails 9 and is lined with rubber.

A grit recovery and cleaning apparatus 21 is mounted at the end of the container C. (As shown in FIG. 3, it can be stowed in the container). The grit recovery apparatus is intended to receive spent grit from the hopper 19. The spent grit is raised by a bucket elevator 22, subjected to an air-wash using compressed air and delivered to a blast pot 23. Two heavy duty rubber blast hoses 24 connect the blast pot 23 to the inlets to the blasting lances 1 for conveying cleaned and recycled grit to the lances.

As indicated above, the container D houses the ancilliary or service equipment comprising an air compressor 25, air dryer 26 and related filtering and control equipment.

The entry and exit racks for the pipes constituted by the bars 8 and 14 and the blasting and spraying stations are conveniently protected from the weather by a roofing 27 which may be constituted by hinged side parts of the sidewalls of containers B and C and fabric covered frames supported by cable roof supports 28, but other forms of protection may be employed.

In the operation of the plant just described, lengths of pipe to be cleaned are laid on the entry rack constituted by the bars 8, the pipes having been first cleaned if necessary with high pressure water or steam to remove grease. If the pipes have threaded ends, then the threads are carefully cleaned by hand or automatically using high pressure water or steam and are then fitted with hollow steel or steel and polyurethane thread protectors. This step is particularly important where the threads are so-called premium threads by which a leak-proof metal-to-seal can be obtained. The thus prepared pipes are then fed, two at a time to the wheeled carriages 10 and the ends of the pipes are connected to the reclaim car 6 so that the pipes are now located at a cleaning station.

The plant is then put into operation and the wheeled carriages 10 and the reclaim car 16 are moved to the left in the drawings so as to move the pipes over the blasting lances 1. At the same time, the pipes are caused to rotate on the carriages; the brushes 11 are set in operation and grit is sprayed through the nozzles in the blasting heads so as to clean the insides of the pipes. Continued movement of the pipes to the left causes the lance support car 3 to be entrained and also moved to the left until the blasting lances have traversed the full length of the pipes, whereafter the pipes are retracted to the position shown in the drawings.

During this time the brushes 11 have cleaned the outsides of the pipes and the dust generated by this cleaning is collected in the dust collector 13. The grit which has been sprayed to clean the inside of the pipes and the attendant dust and mill scale or the like debris removed from the pipes is collected in the reclaim car where the settled material is conveyed by the screw conveyor 18 to the hopper 19, the dust being collected in the dust collector 20 for subsequent removal. At the end of the blasting operation, the reclaim car 16 moves to the right to deposit the contents of the hopper 19 into an inlet hopper 29 of the grit cleaner 21 in which the grit is separated from the dust, cleaned by an air wash and deposited in the blast pot for subsequent use.

After the blasting operation, all traces of dust and grit are blown from the insides of the pipes using clean, dry compressed air supplied from the equipment in container D.

The cleaned pipes are then taken off the carriages 10 and moved one at a time to the centering stop 15. In this position the spray lance 4 is operated and is first moved by the hydraulic power unit along the length of the pipe. The end of the lance 4 is fitted with a nozzle for spraying a liquid over 360° and with a sizing drift 30 which is means for testing the internal diameter of the pipe and indicating if the pipe should be in any way deformed or of unacceptable ovality or dimension. Any unacceptable pipes are thereupon rejected. It will be appreciated that due to the presence of mill scale, deposits, etc., fine testing of the ovality of the pipe cannot be carried out in the uncleaned pipe.

After the lance 4 has traversed the pipe, a spray unit 31 is switched on and on its return pass down the pipe, the lance sprays the interior of the pipe with a rust-inhibitor or any other desired treatment liquid. The treatment of the pipe with the spray lance 4 takes less time than the blasting treating and this is why it is desirable to have two pipes at the cleaning station subjected to blast cleaning at the same time.

The treated pipe is then conveyed along the bars 14 of the exit rack, where the thread protectors are removed and the pipe is carefully checked to see that no grit or dust is present. The threads are then cleaned again, inspected and blown dry, whereafter they are greased and thread protectors are placed in them. As indicated above, this treatment of the threads is of particular importance where the threads are premium threads, but will be omitted if unthreaded lengths of pipe for subsequent joining by welding are to be cleaned.

As described above, the whole plant is mounted in standard I.S.O., shipping containers so that it can be made mobile and transported to a site where pipes are to be cleaned. In order to stow the plant described into the containers the lances 1 and 4 which are longer than a container are conveniently made in two sections and stored on racks in container A. The grit cleaner 21 is turned into a horizontal position and stowed in container C. The containers are then disconnected from one another, closed and are then ready for shipment.

It will be appreciated that many modifications of the plant just described are possible and the plant may be adapted for various sizes of pipe. Preferably, however, the plant should be capable of dealing with lengths of pipe of up to 45′ (13.7 m.) in length and up to 13⅜″ (34 cm.) in diameter. In general, but particularly for larger pipe diameters it is preferable to provide the lances, particularly the lance 4 with means for centering them during their traverse of the pipes.

Although the plant shown in FIGS. 1 and 2 is described as being contained stored in four containers, it will be appreciated that other arrangements are possible and FIG. 3 shows how the plant can be stored in three containers A′, B′ and C′ in the case where a source of compressed air is available on site.

Container A′ is provided with means for accommodating or storing the lances 1 which are in two parts, a first part of the lance 4 exit rack and the bars 14. The container B′ contains or store the remainder of the lance 4, the equipment for cleaning the outsides of the pipes, entry rack the bars 8 and, in this case, the grit cleaner 21. The container C′ contains the reclaim car 16, with its attendant dust collector 20, as well as an air dryer and related equipment.

Figure 4:
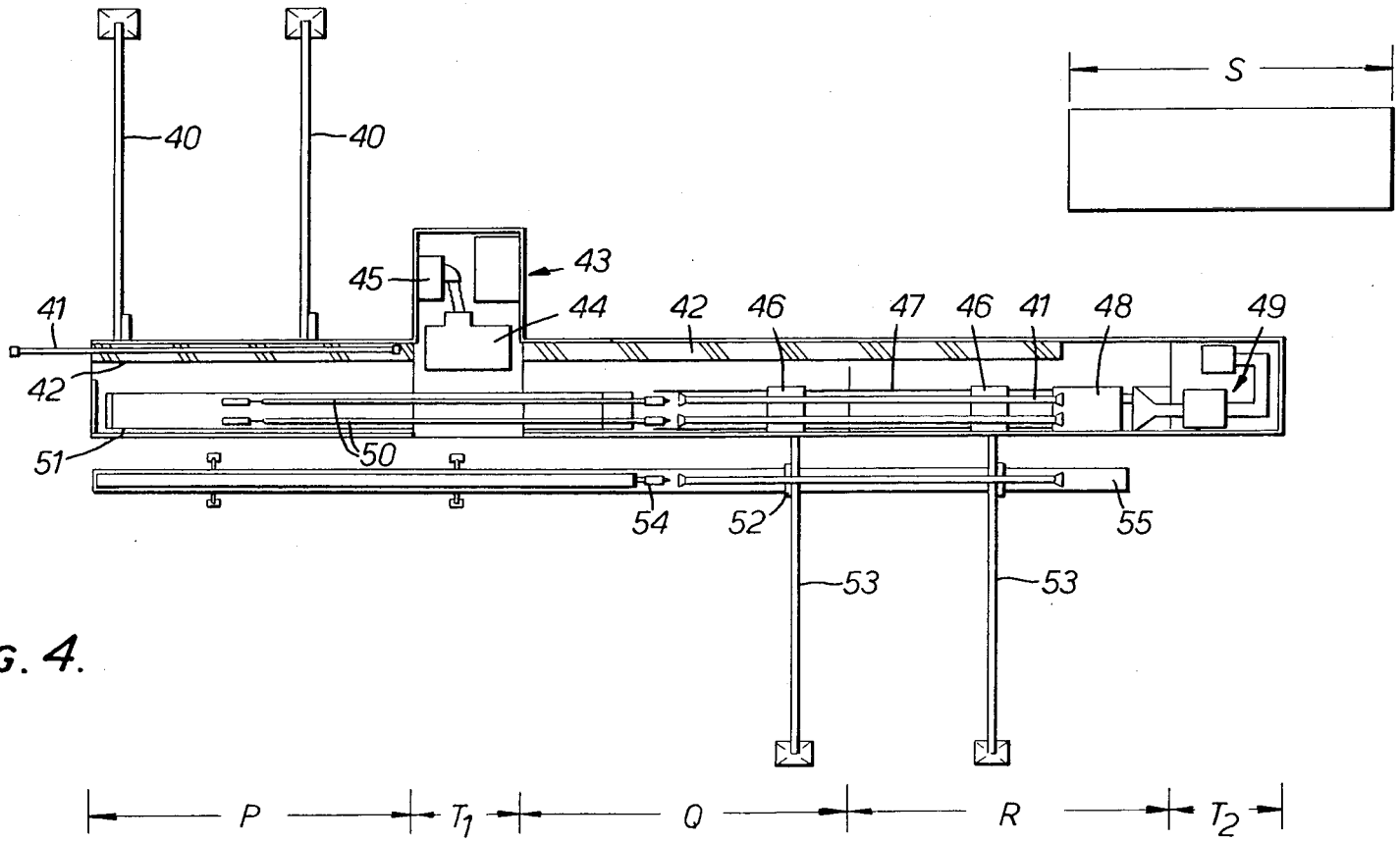
FIG. 4 is a highly schematic plan view of another pipe-cleaning plant.

Referring now to FIG. 4, there is shown another embodiment of a mobile pipe cleaning plant which is formed from four standard 40′ (12.2 m) standard I.S.O. shipping containers P, Q, R and S and two 20′ (6.1 m) containers $T_1$ and $T_2$, the container $T_1$ being positioned on its side between containers P and Q and the container $T_2$ being positioned upright at the end of container R. The container 3 is separated from the others and contains service equipment.

In the plant shown in FIG. 4, an entry unit comprising bars 40 (similar to the bars 8) feeds the incoming pipes 41 to a screw conveyor 42 extending along the containers P and Q and into the container R. The pipes are rapidly conveyed by the conveyor 42 through an abrasive cleaning installation 43 mounted in the container $T_1$. The installation comprises a unit 44 for blasting the outside of the pipe with grit, the unit conveniently being a "Wheelabrator" (Trade Mark), with associated dust collecting apparatus 45. When a pipe reaches the end of the conveyor 42 it is lifted out of the conveyor by means not shown and deposited on two wheeled carriages 45 movable on rails 47, each carriage being adapted to support two pipes 41.

In contradistinction to the plant described with reference to FIGS. 1 to 3, the grit recovery means is not in the form of a mobile reclaim car but is a stationary reclaim booth 48 mounted at the end of the container R and connected to grit-recovery and dust-collecting equipment 49 mounts in the container $T_2$, this equipment being similar to that described with reference to FIGS. 1 to 3.

When two pipes have arrived on the wheeled carraiges 46, the carriages move to the right in FIG. 4 to position the ends of the pipes in the reclaim booth 48. The pipes are rotated about their axes and two blast lances 50, which are movable mounted in a frame 51, are then passed down the insides of the pipes to clean them by spraying with grit or other abrasive material. The lances 50 are movable hydraulically but the means for moving them and supplying them with grit is not described in greater detail.

At the completion of the blasting operation, the pipes are disconnected from the reclaim booth, blown clean and transferred one at a time to a centering station 52 on exit bars 53. At this station, the inside of the pipe is dimensionally checked and sprayed with rust-inhibitor liquid by an auxiliary lance 54 similar to the lance 4 in FIGS. 1 to 3, the lance being mounted above a gutter or catch pan 55 to recover excess liquid. The cleaned pipes are then removed from the exit bars 53.

In other respects the plant shown in FIG. 4 is identical with or similar to the plant shown in FIGS. 1 to 3 and need not be described in further detail.

It will be appreciated that many modifications of the plants described in the drawings may be made and that the sequence of cleaning the insides and outsides of the pipes may be reversed or combined. In the plant described with reference to FIG. 4, the abrasive cleaning installation 43 using grit-blasting may be replaced by rotating wire brushes as used in the plant described with reference to FIGS. 1 to 3, and vice versa.

Furthermore, in a modification of the plant shown in FIG. 4, the pipes are fed into the plant along the bars 53 on to the carriages 46 and the lance 54 is associated with the bars 40 so that the inside of the pipe is dimensionally checked and treated with rust-inhibitor liquid immediately after the external surface has been cleaned.

It will also be appreciated that in some cases it may not be necessary to clean the outside of the pipes and this will lead to a concommitant simplification of the plant.

The present plant has the advantage that it is mobile and can be transported to site. It is capable of cleaning and treating old pipes and tubes which have become scaled or covered with internal deposits through use, but is particularly suitable for treating new pipes and tubes to remove mill scale. The plant is simple to operate and since it is equipped with a substantially closed cycle for the grit and with dust recovery equipment, atmospheric contamination is reduced to a minimum.

We claim:

1. A self contained, mobile plant for cleaning or treating the inside of pipe, said plant comprising a plurality of standard I.S.O. shipping containers having a length between oppossed ends and sidewalls therebetween that cooperate to constitute a mobile and self-contained plant, said containers being adapted for end to end disposition in an operative arrangement with one another on site during use as a plant but being separate one from the other during transport from one use site to another, each container containing at least one item for cleaning or treating the inside surface of pipe, said items comprising an entry rack for receiving pipe to be cleaned or treated, a first carriage for supporting pipe upon receipt from said entry rack, an elongated lance, a spray device fixed to said lance, a second carriage to support said lance, a conveyor for feeding cleaning or treating material to said spray device, a drive connected with at least one of said carriage for moving pipe relative to said lance while said spray device cleans or treats the inside surface of said pipe, and an exit rack for receiving the cleaned or treated pipe, rails mounted in at least two of said containers and extending generally parallel the sidewalls of said two containers, said rails of said two containers cooperating with one another when said containers are in said operative arrangement, at least one of said carriages being movable along said rails to permit relative movement between said lance and pipe over a length greater than the length of a single container so that said plant can clean pipe of a length greater than the length of a single container when said containers are in said operative arrangement, said entry and exit racks being storable in said containers and being erectable in substantially normal disposition to said end to end operative arrangement of said container, at least a first said sidewall on at least one of said operative arrangement of said containers being hinged to its respective said shipping container at an upper edge thereof, said first sidewall being openable for its full depth to reveal a portion of a first opening to permit passage of pipe along said entry rack transversely through said first opening onto said first carriage when said first sidewall is opened at least a second said sidewall on at least one of said containers on another side of said operative arrangement of said containers being hinged to its respective said shipping container at an upper edge thereof, said second sidewall being openable for its full depth to reveal a portion of a second opening to permit passage of pipe from said first carriage on to said exit rack in a direction transverse to said second opening when said second sidewalls are opened, both said openings permitting passage to and from said first carriage of pipe of a length greater than the length of a single said container, said sidewalls being adapted to provide protective roofs over said entry and exit racks when said first and second sideswalls are opened and said entry and exit racks are erected, and said first and second sidewalls being closed during transport of said plant from one use site to another, and cable support means for supporting the roofs of the containers defining said opening portions, whereby said openings are adapted to permit passage therethrough of pipe of a length greater than the length of a single container.

2. The plant of claim 1, said lance and said spray device being adapted to spray anb abrasive material for cleaning the inside surface of pipe.

3. The plant of claim 2, said plant further comprising apparatus for recovering and recycling said abrasive material.

4. The plant of claim 2, said lance being fixed and said first carriage being movable in order to move pipe long said lance.

5. The plant of claim 3 or 4, said abrasive material recovery appartus being movable together with said first carriage.

6. The plant of claims 2 or 3, said lance being movable along a pipe from one end thereof, and said first carriage being movable to position the other end of pipe into operative engagement with said abrasive material recovery apparatus.

7. The plant of claim 1, said plant further comprising apparatus for cleaning the outside surface of pipe, and apparatus for moving the pipe axially of itself relative to said outside cleaning apparatus.

8. The plant of claim 7, said outside surface cleaning apparatus comprising an abrasive material spray device.

9. The plant of claim 7, said outside surface cleaning apparatus comprising wire brushes.

10. The plant of claim 1, said plant comprising rotation means for rotating pipe during the cleaning thereof.

11. The plant of claim 1, said plant further comprising a movable auxiliary lance, apparatus for moving said auxiliary lance along a pipe, and at least one of (a) a testing device on said auxiliary lance for testing or checking the inside surface of pipe, and (b) a spraying device on said auxiliary lance for spraying the inside surface of pipe with a treatment liquid.

12. The plant of claims 2 or 11, said plant comprising two main lances for spraying abrasive material, and an auxiliary lance spaced from said main lances for spraying each pipe previously treated by a main lance.

* * * * *

UNITED STATES PATENT AND TRADEMARK OFFICE

CERTIFICATE OF CORRECTION

PATENT NO. : 4,704,986

DATED : November 10, 1987

INVENTOR(S) : Stephen E. Remp

It is certified that error appears in the above-identified patent and that said Letters Patent is hereby corrected as shown below:

In column 8 at line 4 after the word "said" (2nd occurrence) the phrase --containers on one side of said-- should be inserted.

Signed and Sealed this

Twelfth Day of July, 1988

*Attest:*

DONALD J. QUIGG

*Attesting Officer*

*Commissioner of Patents and Trademarks*